US010472839B2

(12) United States Patent
Khamis et al.

(10) Patent No.: US 10,472,839 B2
(45) **Date of Patent: *Nov. 12, 2019**

(54) BEACH ENTRY FIBERGLASS POOL SYSTEM

(71) Applicant: Thursday Pools, Fortville, IN (US)

(72) Inventors: William Khamis, Fortville, IN (US); Edward Vondell, Fishers, IN (US)

(73) Assignee: Thursday Pools, Fortville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/971,014

(22) Filed: May 4, 2018

(65) Prior Publication Data

US 2019/0169867 A1 Jun. 6, 2019

Related U.S. Application Data

(63) Continuation-in-part of application No. 15/862,014, filed on Jan. 4, 2018.

(51) Int. Cl.
*E04H 4/00* (2006.01)
*E04H 4/14* (2006.01)

(52) U.S. Cl.
CPC ..... *E04H 4/0018* (2013.01); *E04H 4/14* (2013.01); *E04H 2004/0068* (2013.01)

(58) Field of Classification Search
CPC .. E04H 4/0018; E04H 4/14; E04H 2004/0068
USPC ..... 4/506
See application file for complete search history.

(56) References Cited

U.S. PATENT DOCUMENTS 2,828,489 A * 4/1958 Baker ..... A47K 3/024 4/589
3,478,370 A * 11/1969 Purpuri ..... E04F 11/16 52/188
3,497,877 A 5/1970 Diemond et al.
3,691,995 A * 9/1972 Little ..... A01K 13/001 119/702
3,708,807 A 1/1973 Chase
3,793,653 A * 2/1974 Brooks ..... E04H 4/0037 4/513
3,823,590 A * 7/1974 Lang ..... B21F 3/04 72/134
3,823,690 A 7/1974 Rynberk
3,908,205 A 9/1975 Chase
(Continued)

FOREIGN PATENT DOCUMENTS

FR 3020392 A1 * 10/2015
GB 1388675 A * 3/1975 ..... A63B 69/12
JP 02112564 4/1990

*Primary Examiner* — Jeanette E Chapman
(74) *Attorney, Agent, or Firm* — C. John Brannon; Brannon Sowers & Cracraft PC

(57) ABSTRACT

A fiberglass swimming pool system, including a fiberglass swimming pool body defining an interior volume for holding water and positioned in an excavation, a fiberglass flange operationally connected to the fiberglass swimming pool body, a fiberglass lip extending from the flange away from the fiberglass swimming pool body, a truncated fiberglass top wall extending perpendicularly from the flange, a fiberglass ramp extending from the elongated fiberglass riser wall into the interior volume, and a deck extending over the lip and operationally connected to the fiberglass ramp at the top wall. The fiberglass ramp has an angle of decline of between one and fifteen degrees.

14 Claims, 13 Drawing Sheets

(56) References Cited

U.S. PATENT DOCUMENTS 3,962,734 A 6/1976 Chase
4,229,843 A * 10/1980 Belanger ..... E04H 4/065 4/495
4,306,394 A * 12/1981 Blakeway ..... E04H 4/142 4/506
4,316,294 A * 2/1982 Baldwin ..... A47K 3/02 4/538
4,466,141 A * 8/1984 Starkey ..... E04H 4/0037 4/488
4,713,849 A * 12/1987 Kindness ..... E04H 4/142 4/496
4,734,944 A * 4/1988 O'Brien ..... A47K 3/022 4/573.1
D298,055 S 10/1988 O'Brien
5,271,692 A * 12/1993 Lochtefeld ..... A63B 69/0093 405/52
5,329,878 A * 7/1994 McCauley ..... A01K 1/0107 119/165
5,400,555 A 3/1995 Kantor
5,417,016 A * 5/1995 Dahowski ..... E04H 4/08 4/496
5,485,707 A * 1/1996 Wilkes ..... E04H 4/14 4/295
5,729,937 A 3/1998 Mantelli
5,738,590 A * 4/1998 Lochtefeld ..... A63B 69/0093 472/117
5,790,990 A 8/1998 Hall
6,491,589 B1 * 12/2002 Lochtefeld ..... A63C 19/00 239/288
6,643,879 B1 * 11/2003 Davis ..... A01K 15/02 14/69.5
7,523,516 B1 * 4/2009 Waddell ..... A01K 1/035 119/847
7,984,518 B1 * 7/2011 Jarvis ..... E04H 4/14 119/847
9,593,455 B2 * 3/2017 Khamis ..... E04H 4/0037
10,358,837 B2 * 7/2019 Khamis ..... E04H 4/0093
2009/0151066 A1 6/2009 Sullivan
2013/0014321 A1 1/2013 Sullivan
2017/0167153 A1 6/2017 Paull

* cited by examiner

BEACH ENTRY FIBERGLASS POOL SYSTEM

CROSS-REFERENCE TO RELATED APPLICATIONS

This patent application is a continuation-in-part (CIP) of, and claims priority to, U.S. patent application Ser. No. 15/862,014, filed on Jan. 4, 2018.

TECHNICAL FIELD

The present novel technology relates generally to the field of fiberglass materials, and, more particularly, to a method and apparatus for providing a beach entry area for in-ground fiberglass pool bodies.

BACKGROUND

Preformed fiberglass swimming pools offer many advantages over vinyl liner and in-situ formed shotcrete or concrete walled swimming pools. Fiberglass pool bodies may be quickly and inexpensively formed and require considerably less effort to put into the ground. Recently, there has been increased interest in swimming pools having a preformed shallow entry area beginning flush with the outside ground at the pool edge and extending into the pool at a shallow angle, such that a swimmer may walk into the pool enjoying a slow and steady entry into the pool as the water gradually becomes deeper. Such an entry area is commonly known as a 'beach entry'. Beach entries are relatively easy to form in concrete pools, as the concrete may be poured and spread to yield a shallow angled beach entry floor extending from the outer edge or lip of the pool into the main pool body. However, such a beach entry area has been elusive in preformed pools, as the lip/flange has to perform other functions, such as engaging poured concrete forming an upper sidewalk around the pool that partially anchors the fiberglass pool in place, engaging and directing backfill around the exterior of the preformed pool body, providing structure to the pool body and/or providing a level surface for orienting the pool body in the excavation.

Thus, there remains a need for a method and apparatus that would allow easy installation of a preformed fiberglass swimming pool body with a preformed unitary, or aftermarket, accessory allowing beach entry. The present novel technology addresses this need.

SUMMARY

The present novel technology relates to a method and apparatus for providing shallow angle beach entry into a fiberglass swimming pool body. One object of the present novel technology is to provide an improved fiberglass swimming pool system. Related objects and advantages of the present novel technology will be apparent from the following description.

DETAILED DESCRIPTION OF THE PREFERRED EMBODIMENT

Figure 1:
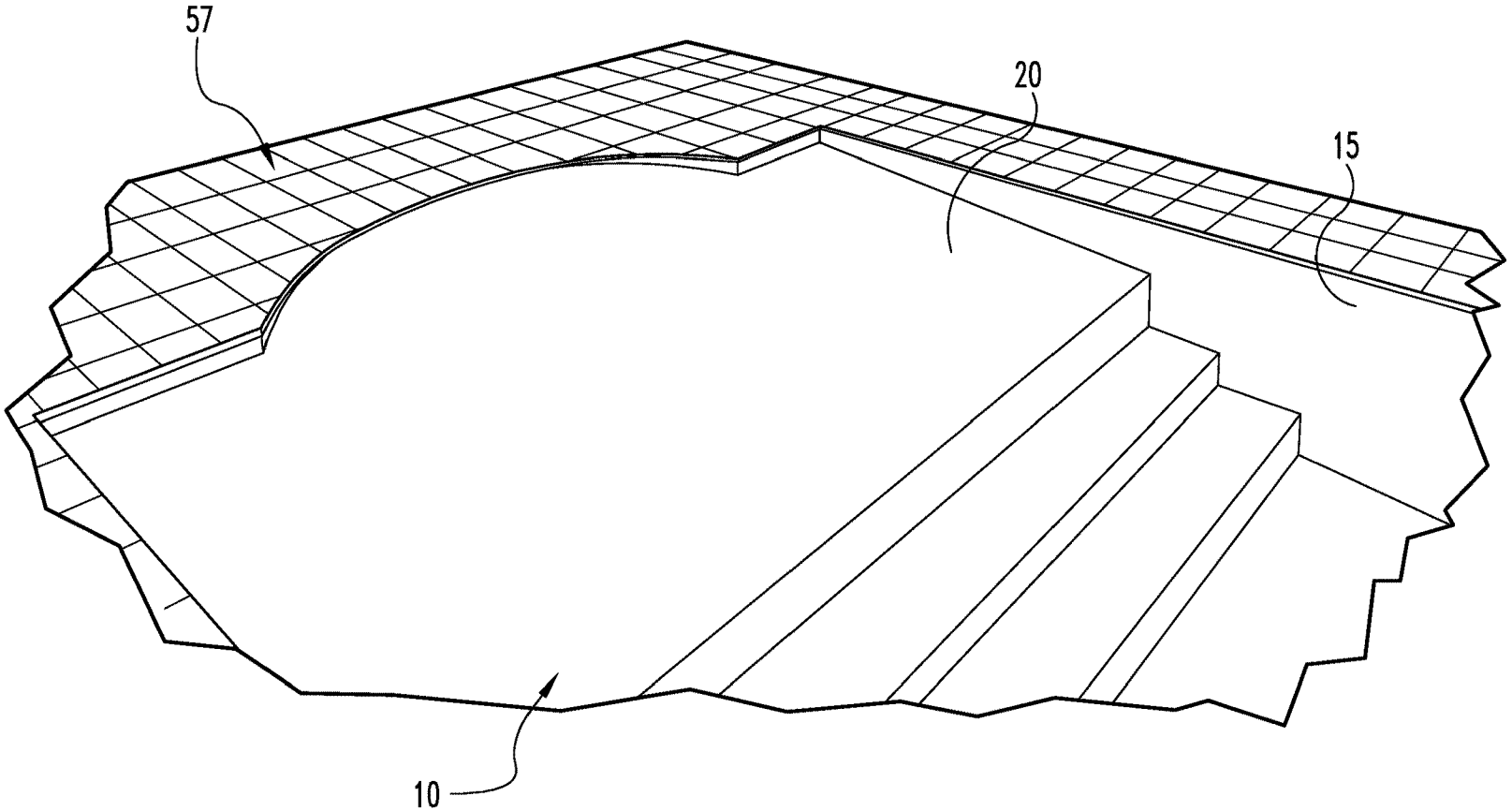
FIG. 1 is a partial side elevation view of a first embodiment fiberglass pool assembly of the present novel technology.
Figure 2:
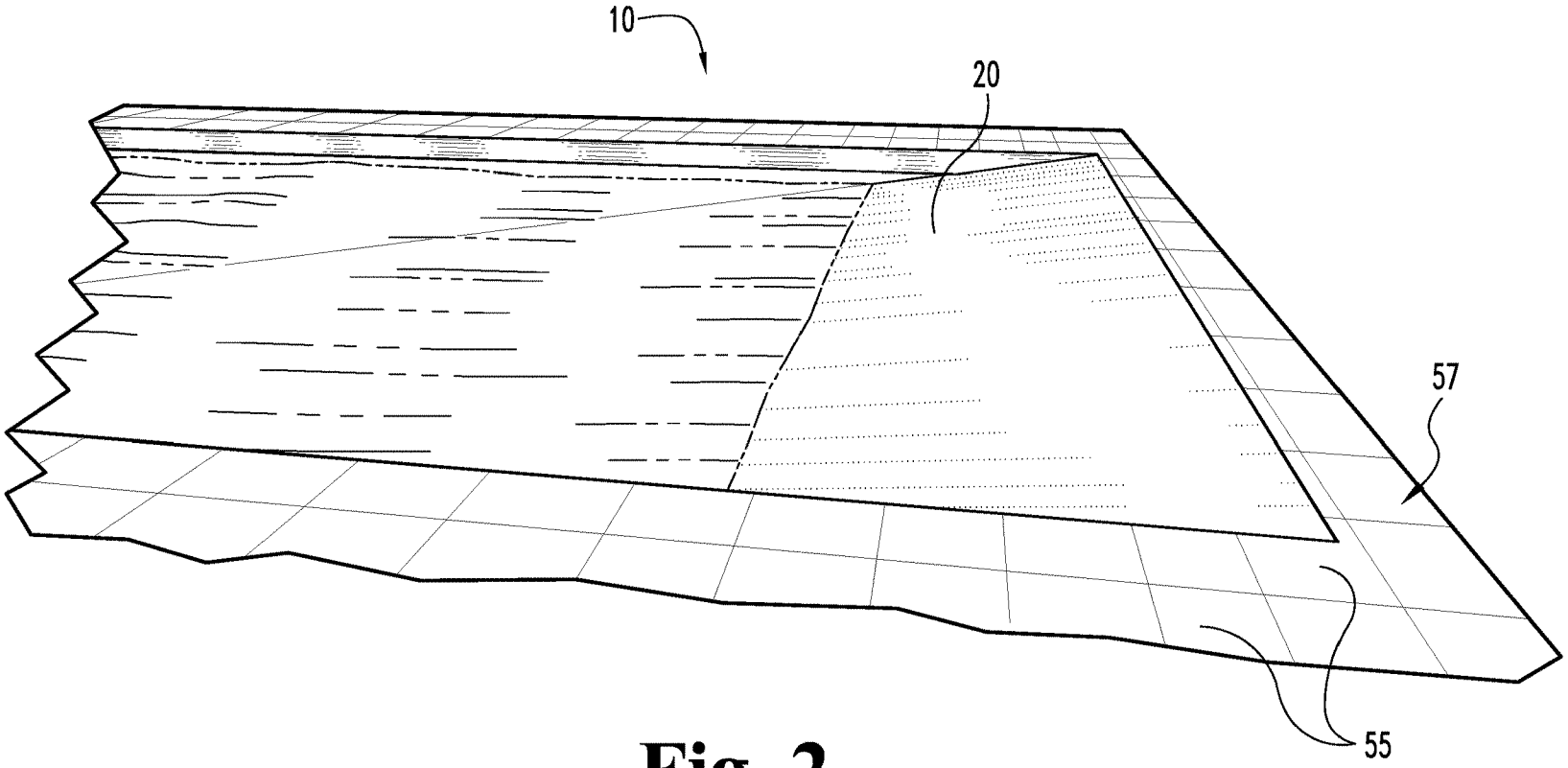
FIG. 2 is a partial side elevation view of a second embodiment fiberglass pool assembly of the present novel technology.
Figure 3:
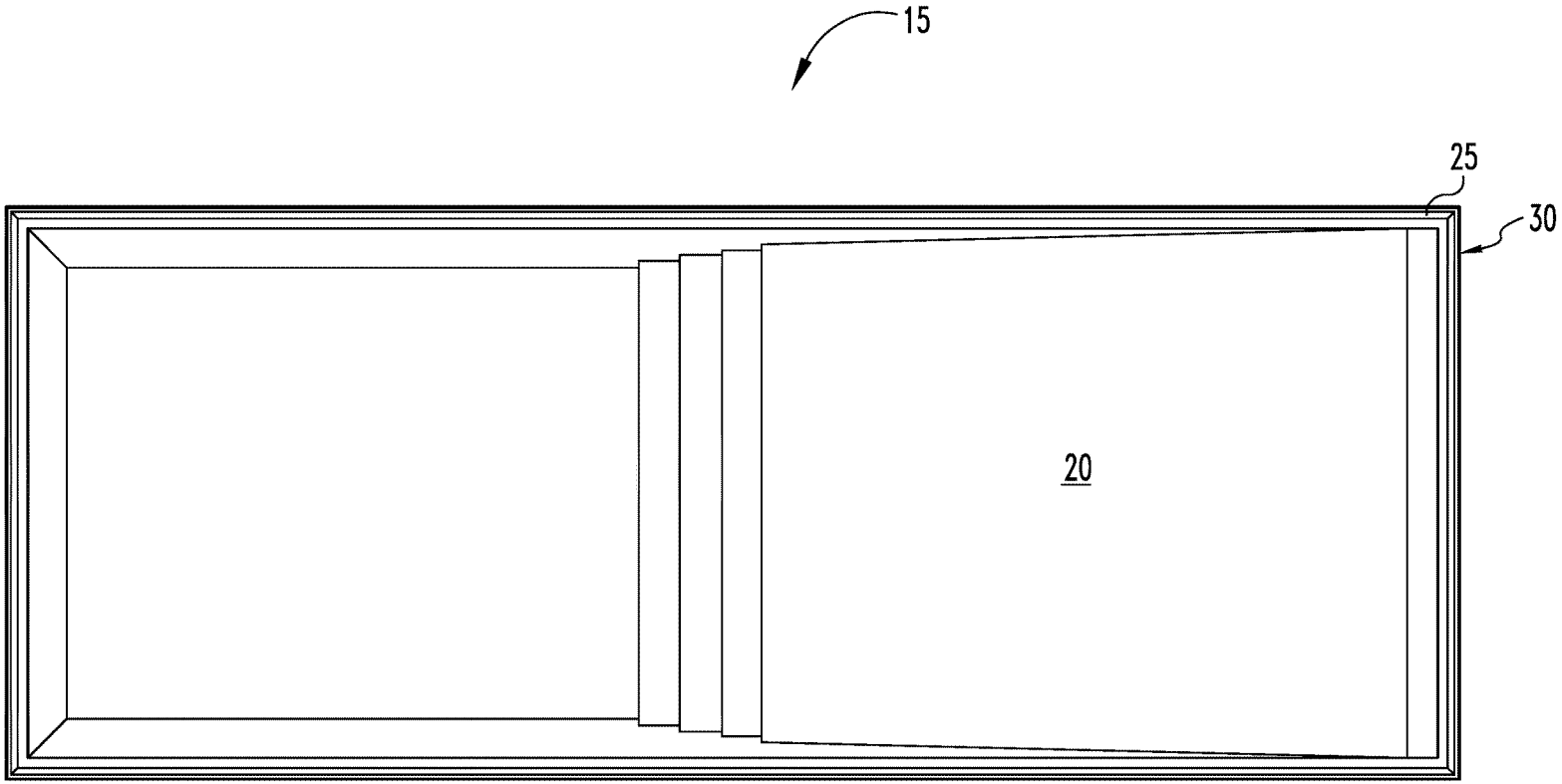
FIG. 3 is a top plan view of a third embodiment fiberglass pool assembly of the present novel technology.
Figure 4:
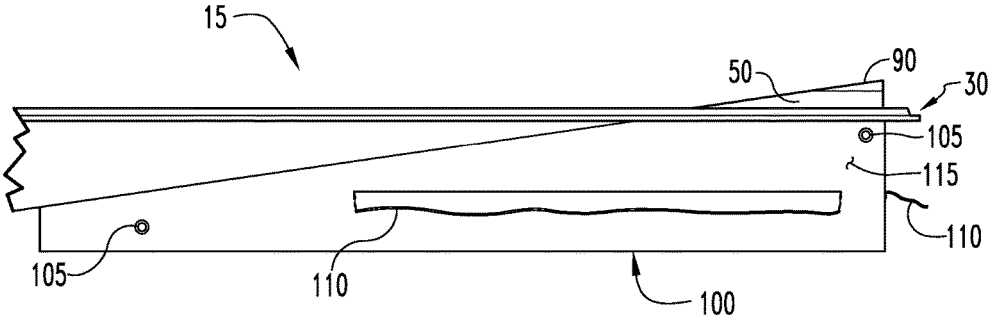
FIG. 4 is a partial side elevation of the pool assembly of FIG. 3.
Figure 5:
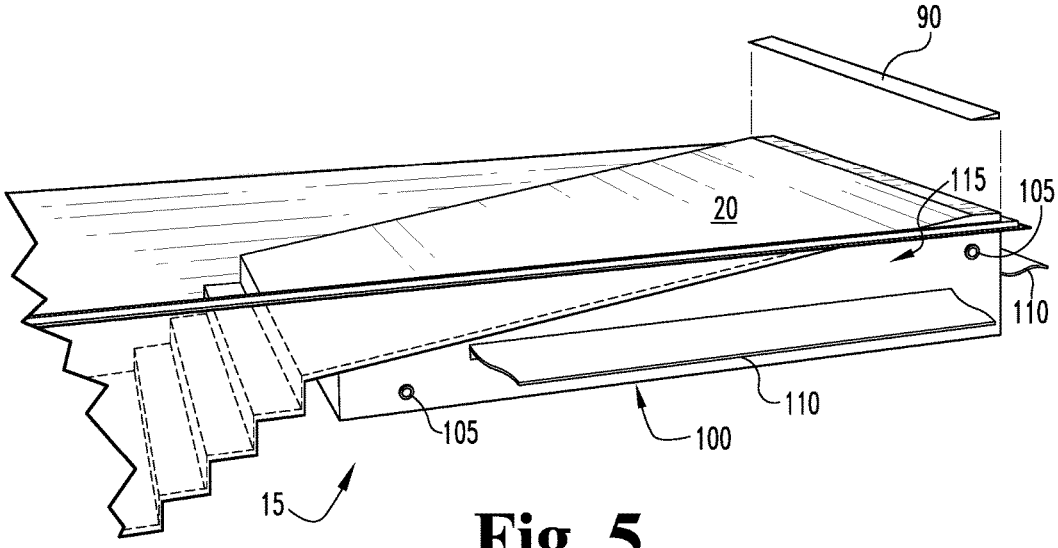
FIG. 5 is a partial top perspective view of the pool assembly of FIG. 3.
Figure 6:
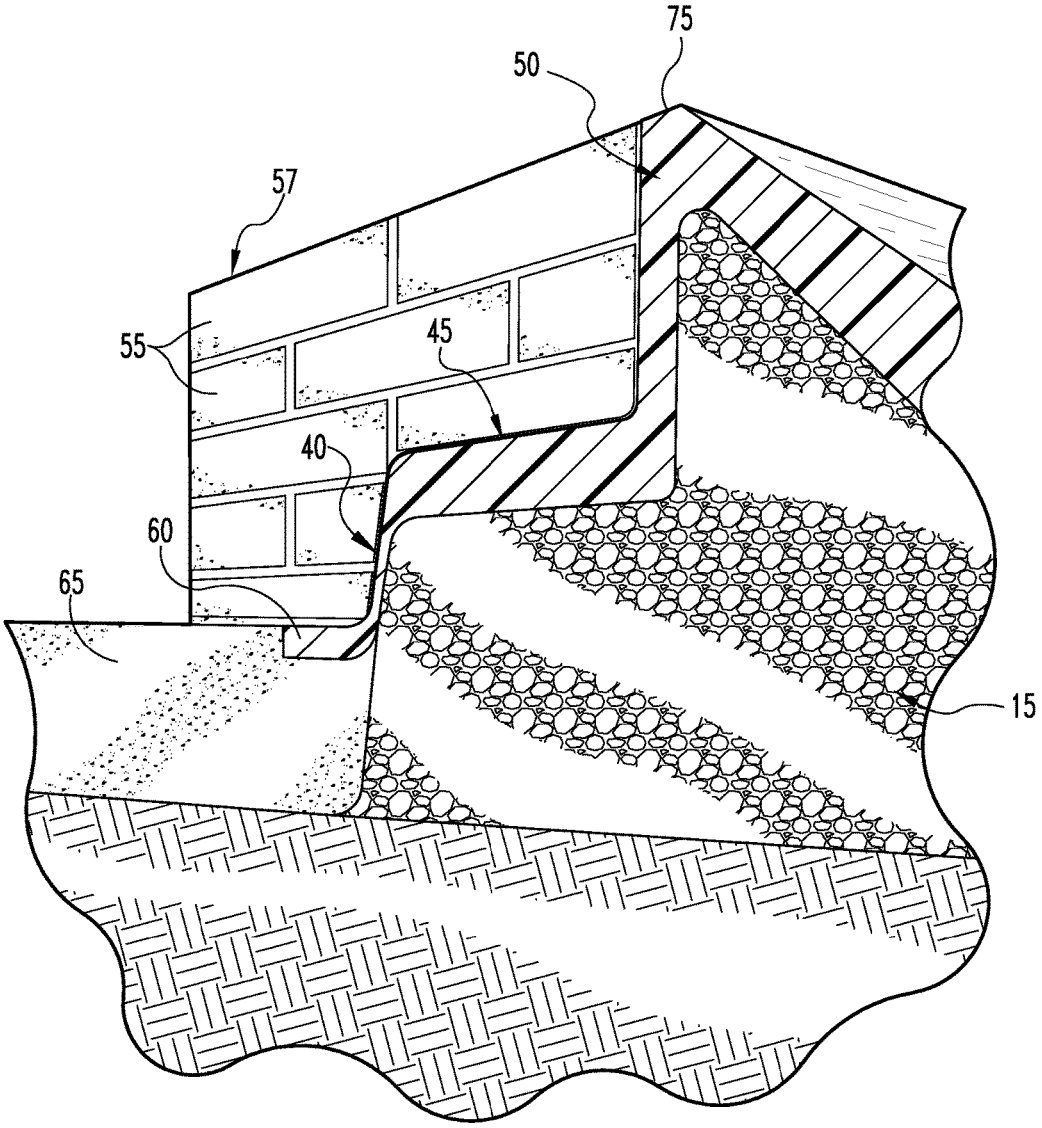
FIG. 6 is an enlarged partial perspective view of the flange/riser portions of FIG. 3.
Figure 7:
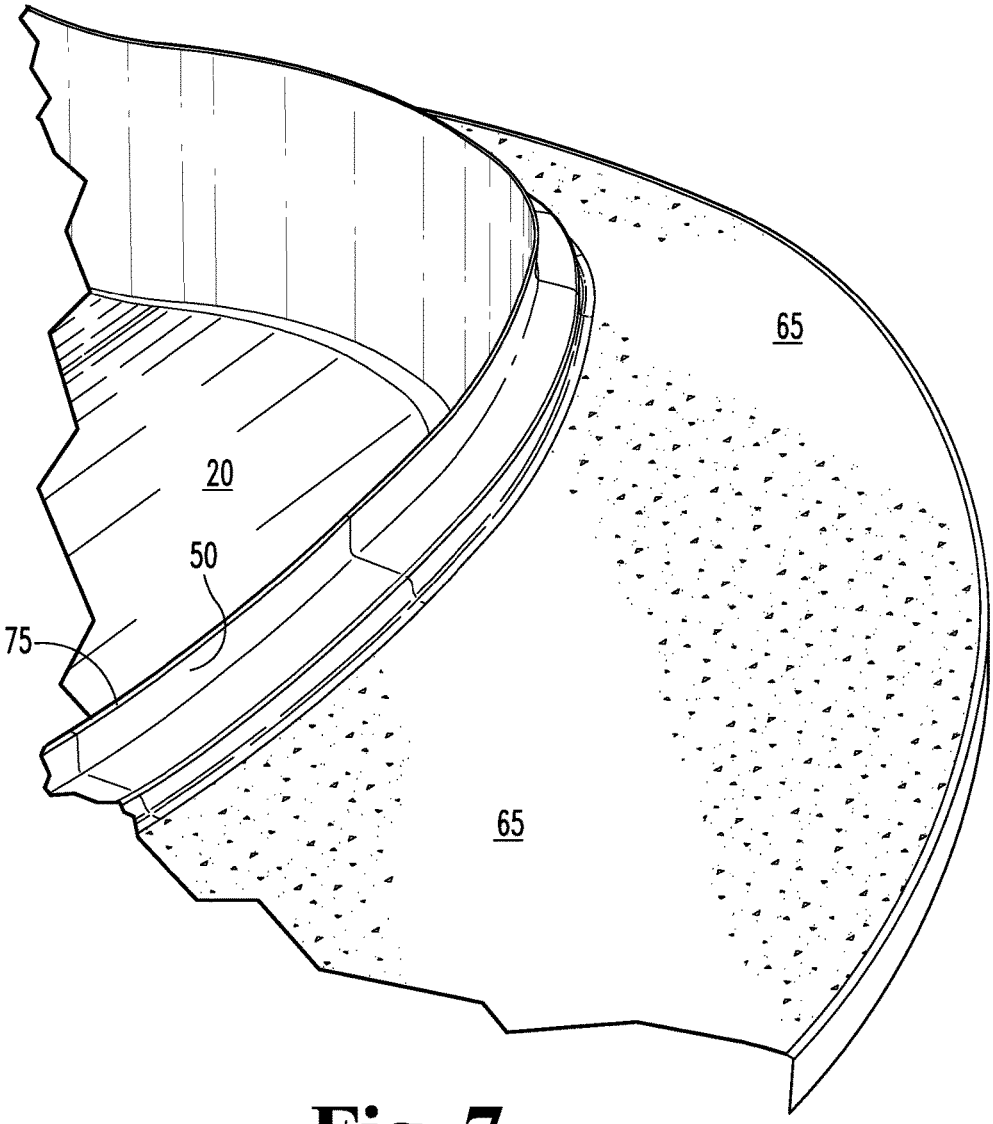
FIG. 7 is a partial perspective view of a bond beam formed around an emplaced pool body.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

The present novel technology relates to an assembly 10 for allowing gradual entry into a fiberglass bodied swimming pool 15, as illustrated in FIGS. 1-13E. The assembly 10 includes a shallow ramp member 20 connected to and extending from an endless upper flange member 25. The endless upper flange member 25 is part of the flange assembly 30 defining the upper perimeter of the swimming pool body 15 as emplaced in the ground. Flange 25 typically has a generally rectangular cross-section with an inner wall 35 (relative the swimming pool body) and outer wall 40, and a top wall 45 extending therebetween. The inner and outer walls 35, 40 are typically oppositely disposed and may be parallel or angled relative one another, and more typically extend generally upwardly when the swimming pool body 15 is emplaced in the ground. Inner and outer walls are typically between 2 and 3 inches in length, and top wall is likewise typically between 2 and 3 inches in length, although in many embodiments inner wall is truncated to the width or thickness of the flange 25.

Flange assembly 30 includes a (typically elongated) flange riser 50 (see FIG. 13A), which extends generally parallel with the inner wall 35 and perpendicular to the top wall 45, typically extending between 1 and 5 inches, more typically between 2 and 4 inches, beyond top wall 45. The flange riser 50 is typically not endless. Flange riser 50 is typically formed flush with inner wall 35, and may be formed as an extension of inner wall 35. Flange riser 50 typically extends beyond the top wall 45 of the flange 25 an equal distance to the thickness of bricks, concrete, pavers, wood, combinations thereof, or like finishing material 55 to be emplaced around the perimeter of the swimming pool body 15 once positioned in the ground to define a deck 57. The finishing material 55 is typically positioned over the bond beam 65 (which envelops lip 60 extending perpendicularly from outer wall 45, typically several inches), so as to assist in anchoring the pool body 15 in place and providing a counter-force opposing groundwater buoyancy forces that may act to push the pool body 15 out of the ground 67 when water levels are low. The pool body 15 is first anchored in place by a concrete pour over the lip 60 to define an anchoring bond beam 65 that surrounds and locks the pool body 15 in place. The additional finishing material 55 is positioned over the bond beam 65 and defines a deck, walkway, or the like 57 leading to the edge of the pool body 15. Flange assembly 30, riser 50, and shallow ramp 20 are typically formed of fiberglass, and are more typically integrally formed with the pool body 15.

Beach entry ramp 20 extends from the top edge 75 of the riser 50 into the pool at a shallow angle of decline into the pool, typically between four and ten degrees, more typically between six and eight degrees, and still more typically about seven degrees, although any convenient angle may be elected, for a predetermined distance, typically at least three feet, more typically between four and twelve feet, more typically between six and ten feet, still more typically about eight feet, and then drops off at a greater angle, often about ninety degrees, defining deeper water and mimicking a shelf drop-off. Put another way, the ramp typically experiences a 1 foot vertically drop for each 7 feet it extends horizontally, with a range of dropping 1 foot for every 6 feet extension to dropping 1 foot for every 14 feet extension.

Figure 8:
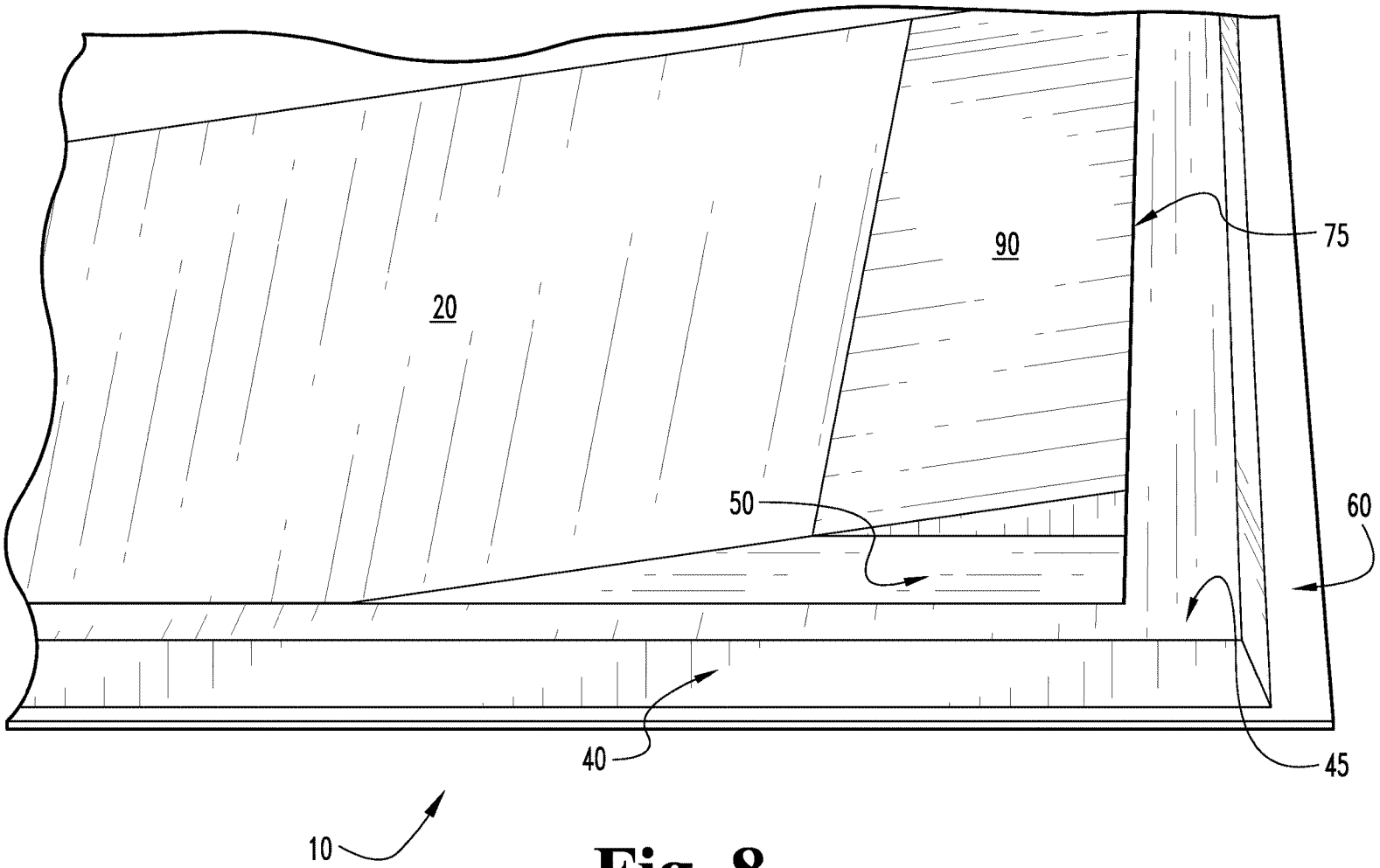
FIG. 8 is a partial top perspective view of the pool assembly of FIG. 3 including a top insert member.

In some embodiments, as illustrated in FIG. 8, a top insert member 90 may be positioned over the beach entry ramp 20, covering the riser 50 and extending therefrom over the shallow ramp portion 20 to adjust the effective coping height of the riser 50 to accommodate variations in deck 57 thickness. Thus, a riser 50 designed to accommodate a two-inch concrete pour may be modified to instead accommodate four-inch pavers or a thicker concrete pour. The insert member 90 is typically adhered to the ramp 20, such as with a fiberglass bond or adhesive material, and finished to blend virtually seamlessly with the underlying pool body 15. In some embodiments, the insert 90 is placed into the mold before the pool body 15 is formed, resulting in a pool body 15 with the riser 50 and ramp 20 adjustments made prior to pool body formation.

In some embodiments, a support structure/backfill eliminator body 100 is positioned beneath the shallow ramp 20 to increase stability, increase ease of installation, and decrease the amount of backfill required to install the pool body 15. The support structure 100 also reduces or eliminates flexure of the shallow ramp when in use.

The support structure 100 is typically a generally hollow housing or body with one or more apertures 105 formed therethrough and is typically made of a lightweight structural material, such as fiberglass, aluminum, or the like, although the support structure 100 may simply be one or more structural members or pillars. Typically, at least one, and more typically a plurality, flexible, tough sheet segment 110 is securely bonded to one or more exterior sidewalls 115 of the support structure 100 for extension therefrom. The support structure 100 is more typically an open-topped enclosure, with the shallow ramp portion, when connected thereto, defining an enclosing top.

Typically, an anchor member 110, such as one or more flexible sheets of geotextile, fiberglass, or like material and/or a rigid anchoring flange formed from fiberglass, aluminum, or like material, or the like, is operationally connected to the support structure 100 to extend therefrom for burial with backfill to assist in anchoring and stabilizing the support structure 100 and the pool body 15. Likewise, anchor members 110 are typically operationally connected to the pool body 15 for extension therefrom and burial with backfill to likewise anchor the pool body 15 in place.

In operation, the pool body 15 is emplaced in an excavation, with a support structure 100 optionally positioned beneath the shallow ramp 20, and the remaining excavation is backfilled with gravel, sand, dirt, and/or the like. In some embodiments, anchor members 110 operationally connected to the pool body 15 and/or the support structure 110 are extended therefrom and buried in the backfill. A bond beam 65 is poured to operationally connect to the pool body 15 and help hold the body 15 in place, and finishing materials are positioned to further assist in anchoring the pool body 15 as well as to define a generally horizontal deck 57 operationally connected to the pool body 15. The deck connects to the top edge 75 of the riser 50 and thus to the shallow ramp 20, to allow a smooth walking transition from the deck 57 into the pool 15 and down the ramp 20 to gradually enter the water.

The pool body 15 may be of any convenient shape, including rectangular, generally rectangular, kidney shaped, round, oval, or the like. The ramp 20 is typically textured to be slip resistant, and may accommodate waders, tanners, as well as chairs and loungers. In some embodiments, the ramp 20 completely replaces stairs for pool entry.

Figure 9A:
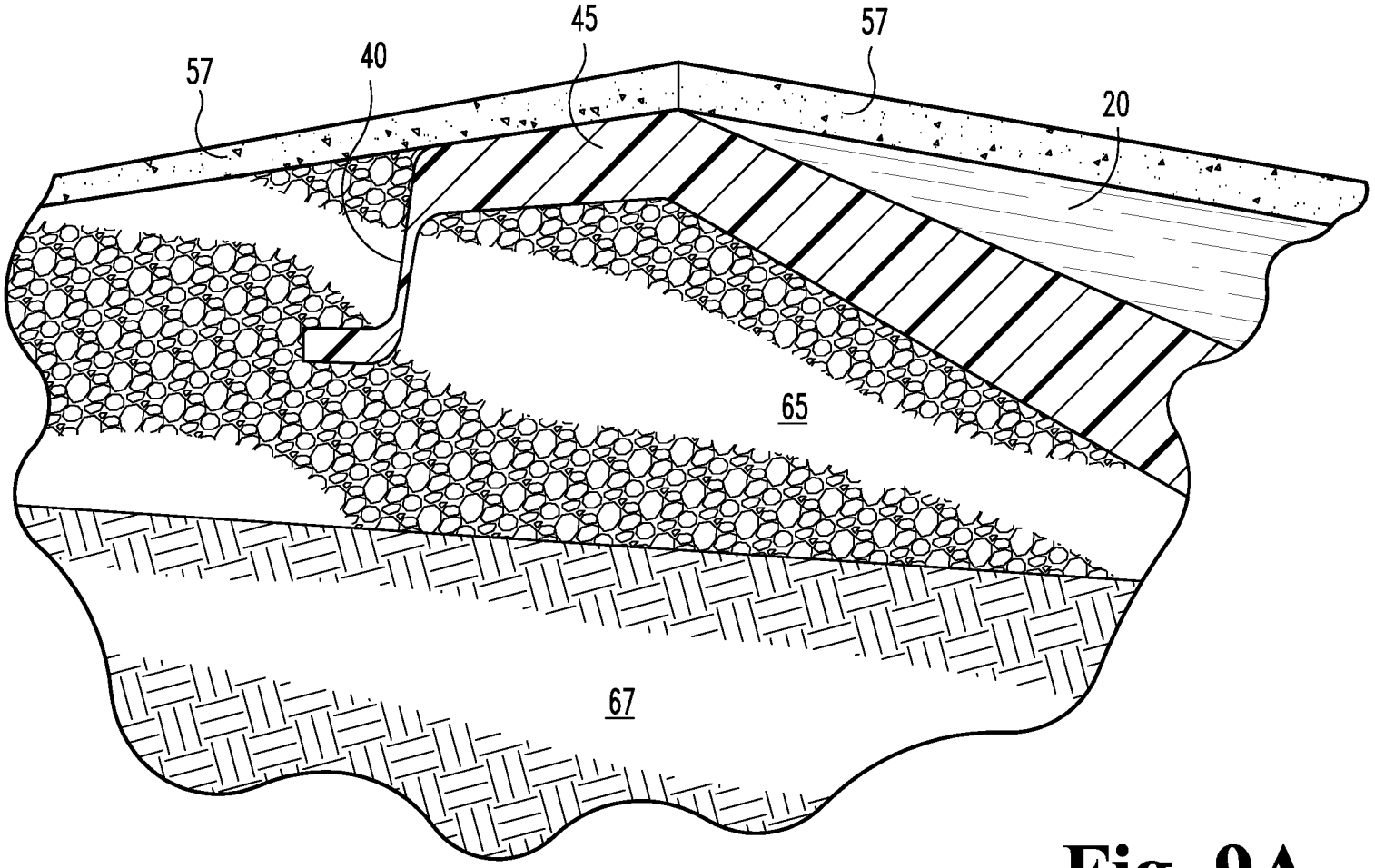
FIG. 9A is an enlarged partial perspective view of the flange and truncated riser portions of FIG. 3.
Figure 9B:
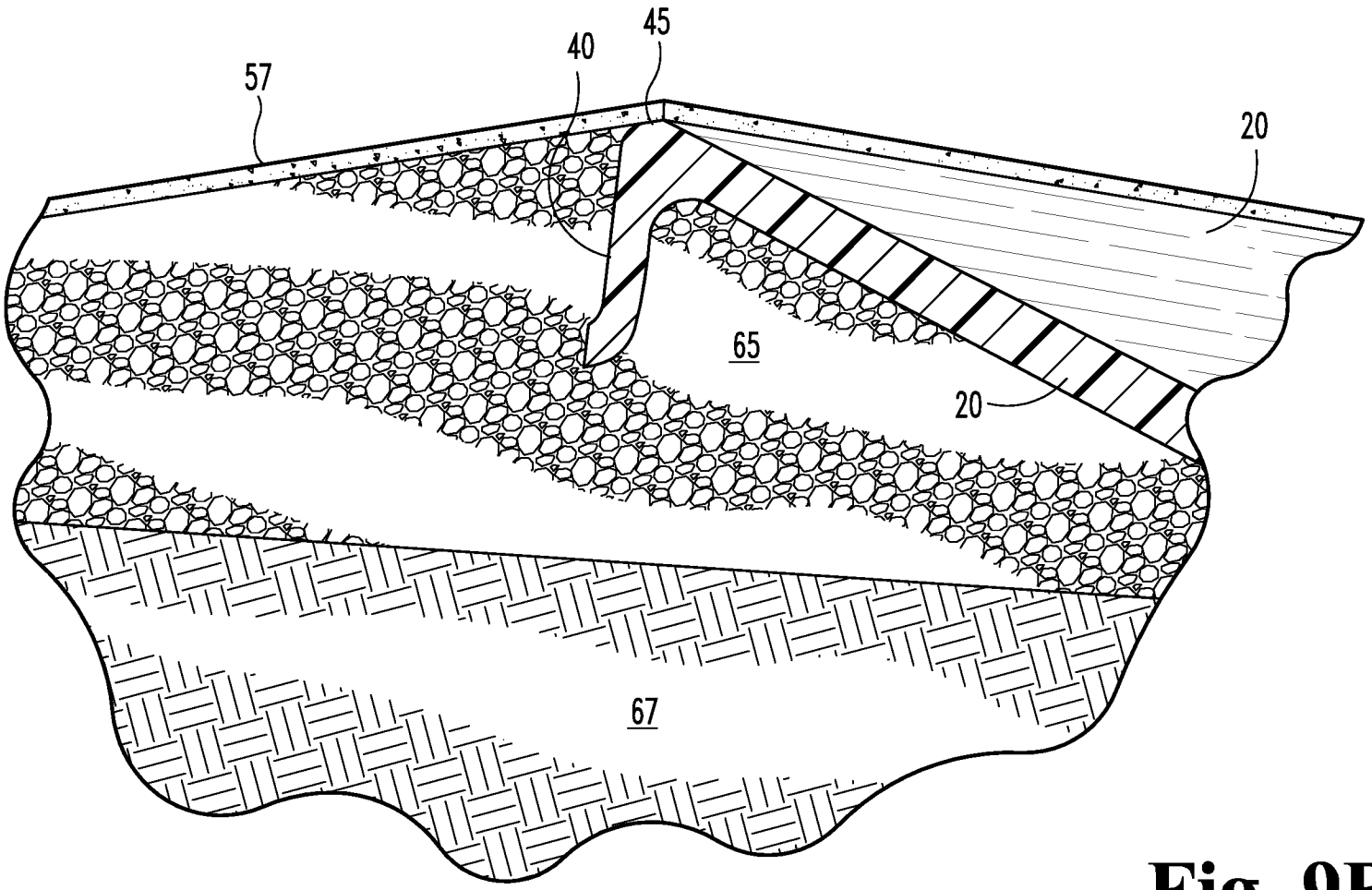
FIG. 9B is an enlarged partial perspective view of the flange and truncated riser portions of FIG. 3 without a lip extending therefrom.

In another embodiment, as illustrated more particularly in FIG. 9, the system 10 is identical to the above embodiment, except wherein flange riser 50 is truncated to extend flush with, or slightly above or below, topwall 45. Deck 57 approaches topwall 45 at a shallow angle and intersects pool ramp at the topwall 45. Pool ramp 20 extends from topwall 45 into the pool body 15 at the same or similar shallow angle. Bond beam material 65 still covers and engages lip 60 to secure pool body 15.

Figure 10:
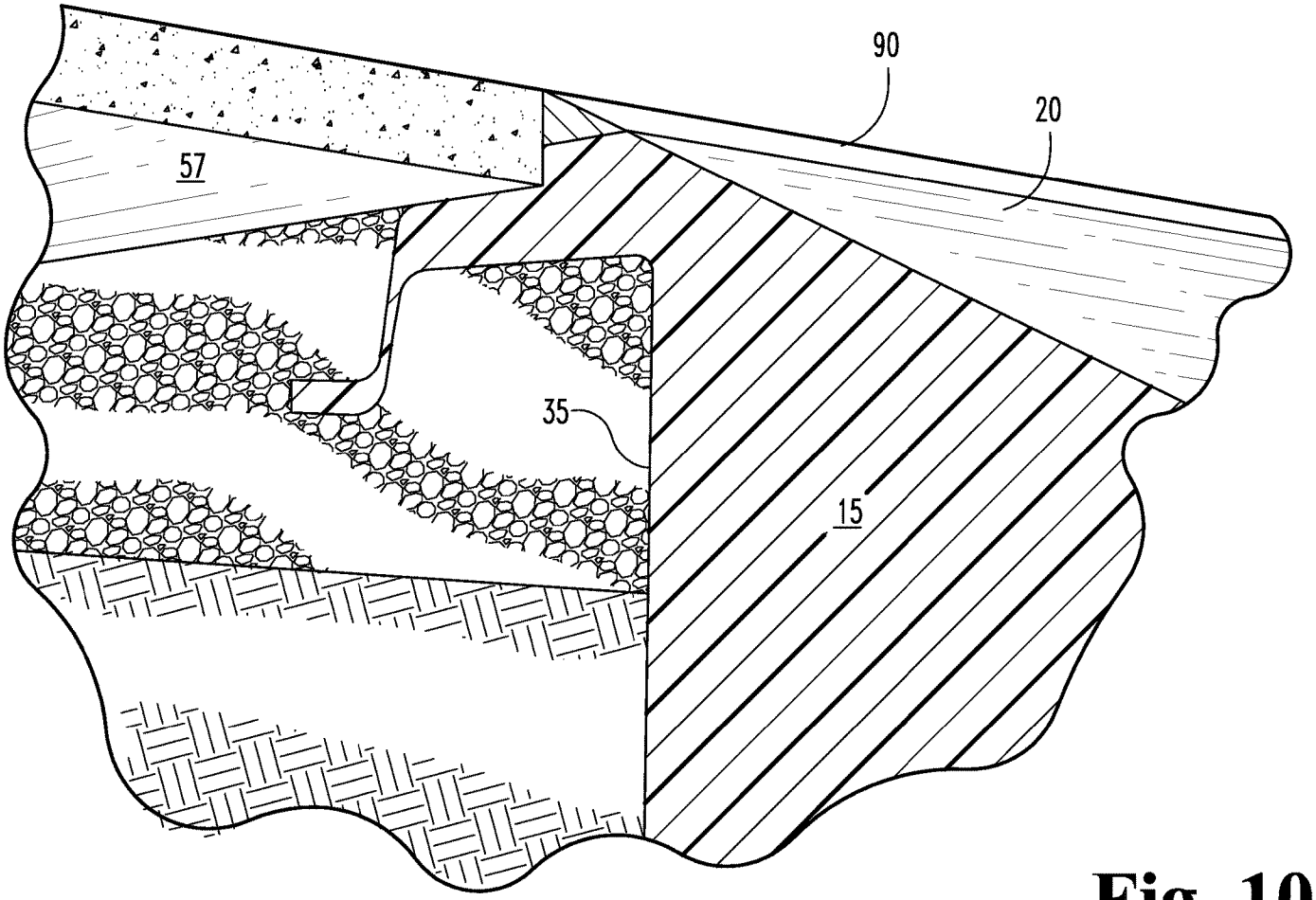
FIG. 10 is an enlarged partial perspective view of the flange and truncated riser and built in deck portions of FIG. 3.
Figure 11:
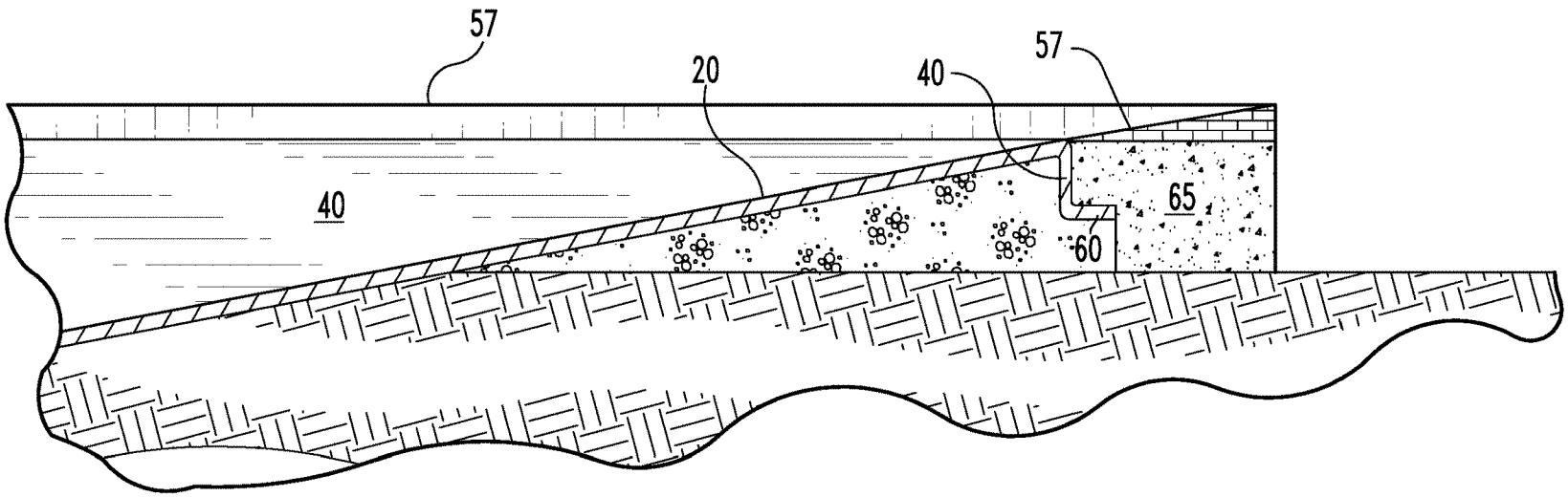
FIG. 11 is an enlarged partial cutaway side view of another embodiment of the fiberglass pool assembly of the present novel technology having a sloped deck transitioning to a similarly sloped pool floor.
Figure 12:
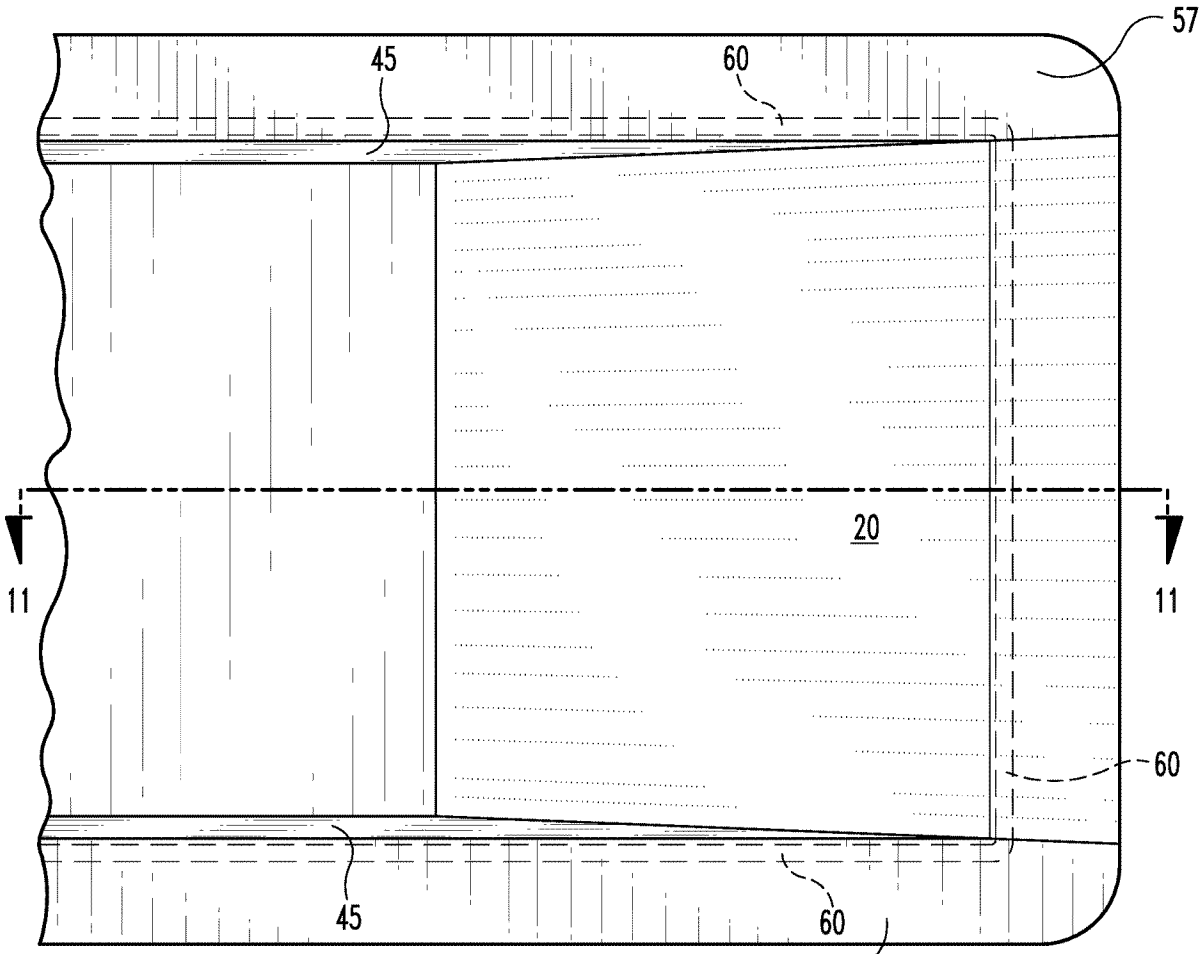
FIG. 12 is a partial top plan view of the embodiment of FIG. 11.

In another embodiment, shown in FIG. 10, a built in, generally horizontal tanning ledge or deck 131 extends between the top wall 45 and the ramp 20.

In yet another embodiment (see FIGS. 11 and 12), similar to that of FIG. 9, the system 10 is again identical to the above embodiments, except wherein flange riser 50 is truncated to extend flush with, or slightly above or below, top wall 45, and top wall 45 is shortened to about an inch. Deck 57 approaches topwall 45 at a shallow angle and intersects pool ramp at the topwall 45. Pool ramp 20 extends from topwall 45 into the pool body 15 at the same or similar shallow angle. Bond beam material 65 still covers and engages lip 60 to secure pool body 15.

Figure 13A:
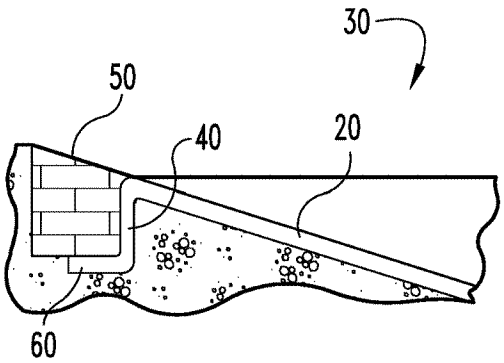
FIG. 13A is a schematic view of an embodiment pool assembly having a flange riser extending from the top of the flange.
Figure 13B:
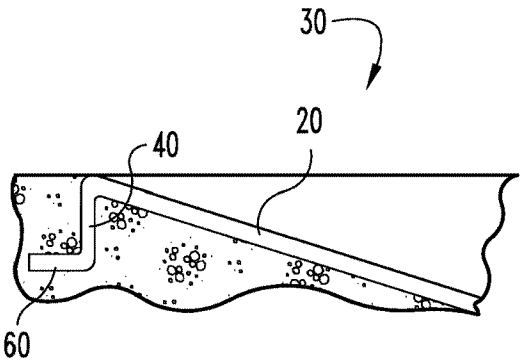
FIG. 13B is a schematic view of an embodiment pool assembly having a flange with a truncated or shortened top wall.
Figure 13C:
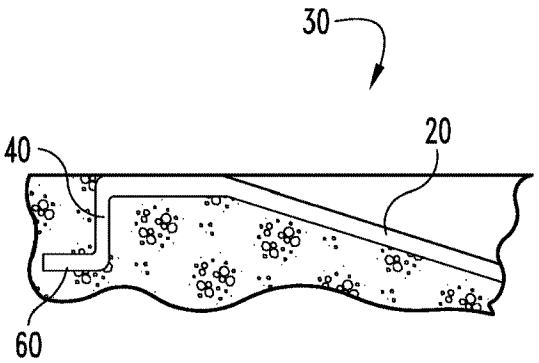
FIG. 13C is a schematic view of an embodiment pool assembly having a flange with an elongated top wall.
Figure 13D:
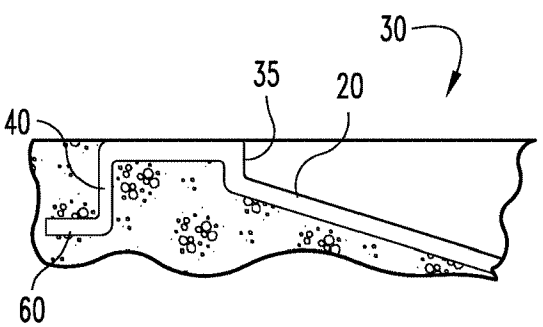
FIG. 13D is a schematic view of an embodiment pool assembly having a flange with an elongated top wall and a truncated vertical inner wall connecting to the beach entry ramp.
Figure 13E:
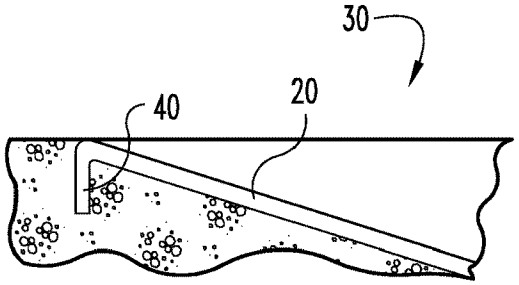
FIG. 13E is a schematic view of an embodiment pool assembly having a flange with an elongated top wall without a lip extending therefrom.

In some embodiments, the flange 25 is truncated with a foreshortened topwall 45 (see FIG. 13B), a foreshortened inner wall (see FIGS. 13B, 13C), and/or a foreshortened outer wall 40 with a truncated or eliminated lip 60 (see FIG. 13E).

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

We claim:

1. A fiberglass swimming pool assembly, comprising:

a fiberglass swimming pool body defining an interior volume;

an endless raised flange surrounding and operationally connected to the fiberglass swimming pool body and defining a perimeter, wherein the endless flange further comprises oppositely disposed inner and outer walls and a top wall extending therebetween;

a lip extending from the endless raised flange and disposed opposite the swimming pool body; and a shallow fiberglass pool floor portion extending from the flange into the interior volume;

wherein the shallow fiberglass pool floor portion is at least three feet long; and wherein the shallow fiberglass pool floor portion defines an angle of decline between four and ten degrees.

2. The assembly of claim 1 wherein the shallow fiberglass pool floor portion is oriented at an angle of decline relative horizontal of between six and eight degrees.

3. The assembly of claim 2 wherein the shallow fiberglass pool floor portion extends from the top wall into the interior volume.

4. The assembly of claim 1 and further comprising a support structure operationally connected to and disposed below the fiberglass pool floor portion.

5. The assembly of claim 1 and further comprising an anchor member operationally connected to, and extendable from, the support structure.

6. The assembly of claim 5 wherein the anchor member is at least one geotextile sheet.

7. The assembly of claim 1 and further comprising a horizontal deck operationally connected between the top wall and the fiberglass pool floor portion.

8. The assembly of claim 7 wherein the swimming pool body is positioned in an excavation and wherein the horizontal deck is selected from the group comprising fiberglass, wood, pavers, concrete, brick, and combinations thereof.

9. The assembly of claim 1 wherein the fiberglass pool floor portion is formed unitarily with the fiberglass swimming pool body.

10. A fiberglass swimming pool system, comprising:

a fiberglass swimming pool body defining an interior volume for holding water and positioned in an excavation;

a fiberglass flange operationally connected to the fiberglass swimming pool body;

a fiberglass lip extending from the flange away from the fiberglass swimming pool body;

a truncated fiberglass top wall extending from the flange; and a fiberglass ramp extending from the truncated fiberglass top wall into the interior volume; and a deck extending over the lip and operationally connected to the fiberglass ramp at the top wall;

wherein the deck and the fiberglass ramp each have a respective angle of decline between one and fifteen degrees.

11. The system of claim 10 wherein the fiberglass swimming pool body, the fiberglass flange, the fiberglass lip, the fiberglass top wall, and the fiberglass ramp are all one unitary piece.

12. The system of claim 10 wherein the deck is selected from the group comprising fiberglass, brick, concrete, wood, pavers, and combinations thereof.

13. The system of claim 10 wherein the top wall is flat and oriented in a horizontal plane.

14. The system of claim 10 wherein the fiberglass ramp has an angle of decline of about seven degrees.

* * * * *